United States Patent [19]

Dischler

[11] Patent Number: 5,065,609

[45] **Date of Patent: * Nov. 19, 1991**

[54] PRESS FOR PRESSING OF CASINGS, CABLE SHOES OR SIMILAR ITEMS

[75] Inventor: Helmut Dischler, Neuss-Uedesheim, Fed. Rep. of Germany

[73] Assignee: Novopress GmbH, KG, Fed. Rep. of Germany

[ * ] Notice: The portion of the term of this patent subsequent to Nov. 19, 2002 has been disclaimed.

[21] Appl. No.: 534,928

[22] Filed: Sep. 22, 1983

[30] Foreign Application Priority Data

Sep. 22, 1982 [DE] Fed. Rep. of Germany ..... 3235040

[51] Int. Cl.[5] ..... B21J 9/18

[52] U.S. Cl. ..... 72/453.15; 72/453.18; 72/410; 72/444; 91/395; 91/410

[58] Field of Search ..... 72/453.01, 453.18, 412, 72/414, 416, 429, 444, 409, 30, 453.15, 410; 91/395, 410

[56] References Cited

U.S. PATENT DOCUMENTS 2,426,492 8/1947 Dupre ..... 72/412
3,735,632 5/1973 Hilton ..... 72/453.01
3,937,050 2/1976 Nicholson ..... 72/416

FOREIGN PATENT DOCUMENTS 1940854 10/1971 Fed. Rep. of Germany .
1627811 5/1972 Fed. Rep. of Germany .
2244105 10/1973 Fed. Rep. of Germany .

*Primary Examiner*—Daniel C. Crane
*Assistant Examiner*—David B. Jones
*Attorney, Agent, or Firm*—James C. Wray

[57] ABSTRACT

A press which is particularly adapted for pressing casings, cable shoes or such items onto a body, having a steering element supported against a drive which on one hand is connected at the press plunger, and on the other hand, is connected with the cylinder, and which upon movement of the press plunger in the working direction, moves the steering element at a fraction of the speed of the press plunger, whereby a locking device, actuated by the workpiece to be pressed, connects the steering element with the press plunger in such a way that the steering element moves with a speed equal to that of the press plunger and that there is an arresting device at the steering element which, in a predetermined position of the press plunger, blocks pressure medium feed to the work room of the cylinder.

20 Claims, 1 Drawing Sheet

PRESS FOR PRESSING OF CASINGS, CABLE SHOES OR SIMILAR ITEMS

BACKGROUND OF THE INVENTION

The invention relates to a press for pressing casings, cable shoes or similar items onto cables or other metallic conductors or bodies. Such presses are especially used in connection with high-voltage installation work. They have a concavely shaped upper die into which the casing and the conductor contained therein are placed. At the upper die a cylinder is attached in which a plunger is movable, which plunger moves the lower die in the direction of the upper die, thereby deforming the casing and the conductor contained therein, if any, and in this manner creates the desired press bonding. In order to ensure operational safety of the press bonding, a specific degree of deformation must be adhered to, which cannot be left to the operator but must be achieved automatically by corresponding means in the press itself. Also, in order to enable the press to function economically and safely, it must be capable of deforming casings or workpieces having different diameters without prior conversion or installation adjustments.

In this connection, German AS 19 40 854 and German OS 22 44 105 disclose presses whose upper dies have wedge-shaped recesses into which the casings or workpieces to be pressed are inserted, and into which they penetrate with varying depth according to their diameters. In the area of the wedge-shaped recesses, there are sensing elements which determine the depth of penetration, and based thereon, ascertain the diameter of the workpiece or casing and terminate the feed of the lower die at a point when the required degree of deformation has been reached. These presses, however, are of complicated mechanical construction and do not permit a choice in the design of the upper die, which in turn results in the inability to manufacture certain desirable cross sectional configurations of the pressed workpiece.

Another press known to the state of the art and serving the same purpose, is disclosed in German patent 16 27 811 and shows an arrangement of two pistons in a cylinder having two chambers, i.e. a press piston and a dosing piston. Coaxially with these pistons, there is a steering mechanism. Under the effect of the pressure medium, introduced into the cylinder, the press plunger is initially moved in the direction of the upper die until the lower die attached thereto engages the workpiece to be pressed. The steering element includes a pressure medium volume which is located between the dosing piston and the press plunger, and as a consequence of the increase in pressure thus incurred, the press plunger is activated by the dosing piston for the purpose of subsequent pressing. The construction of such a press is extremely expensive, if for no other reason than the necessity of two pistons. If there is air in the pressure fluid, which cannot always be avoided when the press is used as a portable unit on construction sites, an incorrect grade of deformation and a faulty pressing will result, because of the air in the sealed pressure medium which determines the depth of penetration.

SUMMARY OF THE INVENTION

It is the objective of the invention to provide a press for the purpose initially described, which is uncomplicated and cost-effective in design, as well as trouble-free in operation, and which reliably achieves the required degree of deforming with a high level of accuracy, and which additionally can have the advantage of being utilized as a press without a predetermined degree of deformation by a simple resetting procedure. Moreover, selection of shapes of the upper and lower dies should be possible over a wide range, with the final cross sections of the pressed products extensively adaptable to the requirements at hand.

The subject of the invention is a press for pressing of casings, cable shoes or the like, having a press body for receiving the upper die, at which press body a cylinder is arranged which contains a slidable press plunger for receiving the lower die, which plunger has a coaxially displacable steering element. This press is characterized in that the steering element is supported against a drive which is in communication on one hand with a press plunger, and on the other hand, with a cylinder, and which when moving the plunger in working direction, moves the steering element at a fraction of the speed of that of the plunger. The press is further characterized in that the plunger is connected with a locking device which, upon contact of the lower die with the workpiece to be pressed, joins the steering element with the plunger in such a way that the steering element travels at a speed equal to that of the plunger, and that the steering element has an arresting device which blocks pressure medium feed to the work room of the cylinder when the plunger is in a preselected position.

The press of the invention is superior to the above described state of the art in that the separation of the cylinder into two chambers and the additional dosing piston can be dispensed with. Determination of the depth of penetration of the lower die into the workpiece occurs strictly by mechanical means and not by enclosed pressure medium volume, so that faulty pressings cannot be caused by air contained in the pressure medium. Furthermore, the degree of deforming can be changed independently of the workpiece diameter in a very simple manner by changing the transmission ratio of the drive, and even the deforming degree which is dependent upon the diameter of the workpiece can easily be changed by positioning the arresting device on the steering element.

In one variation of the press, according to the invention, the drive consists of a lever which is hinged at the cylinder on one end and is hinged with the press plunger at the other end, and which supports the steering element between the pivotal points. The transmission ratio of the drive can be chosen by the distance of the support points of the steering element from the pivotal points of the lever. In a preferred variation, the pivotal points of the lever have equal distance from the steering element, with the result that the steering element is moving with the old speed of the press cylinder. In order to be able to accomodate workpieces of widely varying diameters, when working with small cylinder diameters, and giving consideration to the distance travelled by the press cylinder after the lower die contacts the workpiece, it may be advantageous to design the lever in the form of an extensible telescope.

In another variation of the invention, the drive consists of two springs, successively arranged in a longitudinal direction, one of which is supported at its free end against the press plunger, and the other one is supported at its free end against the cylinder, while the adjacent ends of the springs are supported against a shoulder which is arranged at the steering element. Here also, the transmission ratio of the drive can be altered in a very simple manner by changing the length and rigidity of the springs. It is preferred that the springs are of equal length and rigidity which results in the steering element moving at a speed which is half of that of the press plunger.

The locking device can be constructed so that it has a clamp piston contained in a cross bore to the passage of the steering element, which piston, in a radially extending blind hole of the press plunger is displaceable in longitudinal direction, against the action of a spring, by the pressure of the pressure medium in the workroom, until one wall of the piston bears against the steering element.

The locking device, which is uncomplicated in design, serves to cause the steering element to be carried along with the press plunger at an equal speed, as soon as the lower die attached to the press plunger, comes into contact with the workpiece. However, assembly and arrangement of the locking device permit it to be rendered inoperative in a very simple manner. This is accomplished by a bore arranged in the press plunger parallel to its longitudinal axis, extending from the upper die to the blind hole, into which a rod can be inserted, which extends into the blind hole to limit the movement of the clamp piston. In this manner, contact of the clamp piston with the steering element can be prevented. In many instances, it becomes necessary to render the locking device inoperative, when certain lower dies are used. According to another feature of the invention, it is advisable to connect the rod with the upper die used, so that when the upper die is placed onto the press body, the locking device becomes inoperative without further manipulation.

The arresting device can be a valve plate fastened to the end which is protruding from the steering element, which plate cooperates with a valve seat arranged at the cylinder. This would constitute a particularly uncomplicated and cost-effective design of the press. However, the steering element may have an activating member for a valve which is located in the pressure medium supply line to the workroom, and finally, there may be an actuating member for a switch which is located in the energy feed of a pressure medium pump at the steering element.

An example of the press according to the invention is described by way of the attached drawings.

DETAILED DESCRIPTION OF THE DRAWINGS

Figure 1:
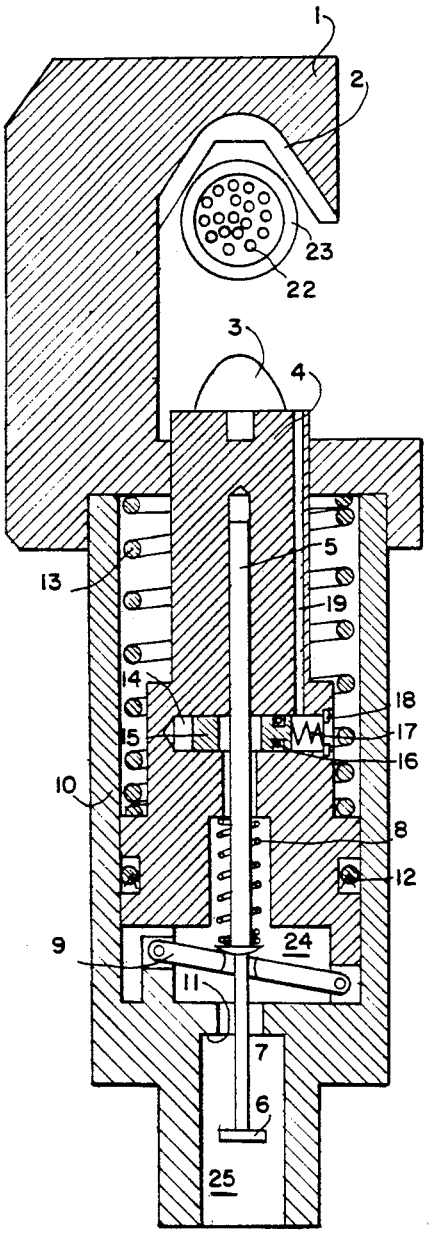
FIG. 1 is a longitudinal view through the press, when the press plunger is at rest.

In FIG. 1, the press body is designated with numeral 1. It carries upper die 2, which is exchangeably arranged therein, permitting the use of upper dies with different inner profiles. The lower die, cooperating with the upper die, is designated with numeral 3. It, likewise, is exchangeably arranged on press plunger 4 so that, also in this case, lower dies of different profiles can be used. Inside press plunger 4, a rod-shaped steering element 5 is arranged in coaxial and displaceable manner, having valve plate 6 at its lower end. Moreover, at steering element 5, there is collar 7 which, by means of spring 8, is pressed against lever 9. Lever 9 is freely pivotably mounted with one end at press plunger 4, and fixedly pivotably connected with the other end at a shoulder in cylinder 10. Lever 9 is constructed in such a way that steering element 5 is freely movable in an opening therein, but collar 7 is incapble of passing through this opening. Cylinder 10 at its inlet has valve seat 11 which cooperates with valve plate 6 to form a valve which, in closed position, prevents pressure liquid from entering workroom 24 of cylinder 10. Displaceable press plunger 4 contained in cylinder 10 is sealed by packing 12 against pressure from workroom 24 and is forced into its rest position by compression spring 13.

For the purpose of forming the locking device, radially extending blind hole 14 is arranged in press plunger 4 in which clamp piston 15 is displaceable. Clamp piston 15, as can be seen in the drawing, has a cross bore through which steering element 5 passes. Moreover, it has packing 16 and is supported by a spring 17 against collar 18 located in blind hole 14. The bore which runs from workroom 24 to blind hole 14 is not sealed, rather it allows the passage of pressure medium present in workroom 24. Also, the part of clamp plunger 15 which is depicted in the drawing to the left of steering element 5, is not pressure medium sealed in blind hole 4. Rather, this fit or guideway permits passage of the pressure medium. Spring 17 is designed such that a pressure rise in workroom 24, resulting from the contact of upper die 3 with workpiece 22, 23 continues against the side of clamp piston 15, depicted in the drawing to the right of steering element 5, and is sufficient to displace clamp piston 15 against the effect of spring 17 in such a manner that its bore side, depicted to the left in the drawing, comes into contact with steering element 5, forming a rigid connection between steering element 5 and press plunger 4. Thereafter, as can be seen, from FIG. 2, steering element 5 is carried along with press plunger 4 at an equal speed, to the point where valve plate 6, at its lower end, seats itself onto valve seat 11 at cylinder 10, thereby preventing further inflow of pressure medium into workroom 24.

Figure 2:
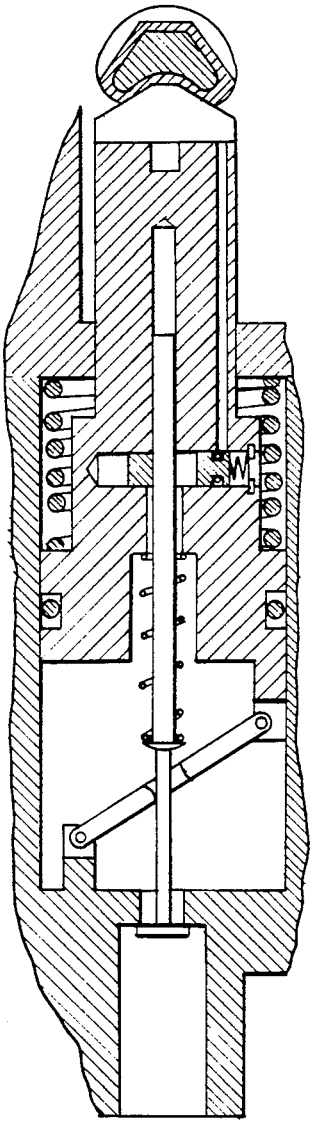
FIG. 2 is a longitudinal view according to FIG. 1 of the end position of the press plunger, whereby nonessential parts have been eliminated.

The press described in FIGS. 1 and 2 provides that initially, pressure medium, for instance, oil delivered by a pressure pump, is introduced into workroom 24 of cylinder 10 via pressure fluid feed opening 25. This results in press plunger 15 and lower die 3 fastened thereto being initially displaced against workpiece 22, 23, located in upper die 2, up to the point when lower die 3 contacts workpiece 22, 23. During this time, steering element 5 also is displaced in the same direction with press plunger 4, however, by the effect of lever 9, the displacement is only at half the speed of press plunger 4. As soon as upper die 3 contacts workpiece 22, 23, pressure rises in workroom 24. As a consequence, clamp piston 15 in blind hole 14, is displaced against the effect of spring 17, so that one wall of its cross bore engages rod-like steering element 5, frictionally connecting it with press plunger 4. From that point on, steering element 5 moves with a speed equal to that of press plunger 4. The movement of press plunger 4 in a direction towards upper die 2, continues until valve plate 6 seats itself against valve seat 11, thereby preventing passage of additional pressure medium into workroom 24. The pressing operation is now completed, and only a discharge of pressure fluid in pressure medium feed line 25 is necessary to lift valve plate 6 off valve seat 11 and to cause spring 13 to return press plunger 4 into its rest position.

The equal distances of the pivotal points of lever 9 from steering element 5, chosen for the example, determine the degree of deformation of workpiece 22, 23. Changing the distances, can change the degree of deformation, if desired.

The drive may be a different one from the one which is used in the example. Instead of lever 9, used in the example, two springs may be used, which longitudinally and successively can be arranged at or around steering element 5. One of the springs is attached to, or supported at plunger 4, the other spring is attached to, or supported at, the bottom of cylinder 10, and both springs are attached to or supported at collar 7 of steering element 5. When both springs are of equal length and rigidity, steering element 5 and press plunger 4 are caused to move in the same direction, however, steering element 5 moves only at half the speed of press plunger 4 until locking device 15 becomes effective. By altering the lengths of the springs and/or spring rigidity, the degree of deformation of workpiece 22, 23, can be changed.

The changes last mentioned, i.e. with regard to alterations in lever ratios or springs, permit change in the degree of deformation, regardless of workpiece or casing diameters. However, the press according to the invention also permits change in the degree of deformation when the diameter is dependent upon workpiece or casing. In the example, the distance between valve plate 6 and valve seat 11 in FIG. 1 corresponds to half the distance between lower die 3 and upper die 2. If, under these circumstances, the distance between valve plate 6 and valve seat 11 is reduced, thinner casings or workpieces become weaker, i.e. they are formed with a smaller degree of deformation than the thicker ones. When, under identical conditions, the distance between valve plate 6 and valve seat 11 is increased, thinner workpieces or casings are pressed with a higher degree of deformation, i.e. they are pressed more strongly than thicker ones.

Further changes effecting the degree of deformation can be made by changing cross sectional configurations of upper die 2 and lower die 3.

Figure 3:
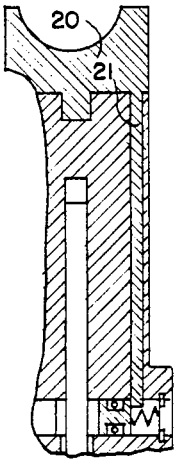
FIG. 3 shows a section of FIG. 1, wherein the locking device has been rendered inoperative.

In the variation of the invention depicted in FIG. 3, rod 21 at lower die 20 serves to limit the path of displacement of clamp piston 15 in such a way that there can be no locking of steering element 5. This is necessary or practical when the stroke of press piston 4 is not to be of preselected size after lower die 20 attached thereto, has reached the workpiece, but instead is determined by the power of the press or the operator. As in these cases, lower dies, for example lower die 20, have a configuration deviating from lower die 3, it is advisable to firmly connect rod 21 with lower die 20. This formation prevents errors in operating the press. On the other hand, it is also possible to provide rod 21, which when being inserted into bore 19, can be pushed into blind hole 14 by any one lower die to such an extent that it limits the movement of clamp piston 15.

While the invention has been described with reference to the specific embodiments, modifications and variations of the invention are apparent without departing from the scope of the invention as defined in the claims.

I claim:

1. Press for pressing of casings, cable shoes or the like, comprising a press body for receiving an upper die, a cylinder connected to the press body, a slidable press plunger disposed within the cylinder for receiving a lower die, a displaceable steering element coaxial with the press plunger, wherein the steering element is supported against a drive, communicating with a press plunger, and with the cylinder, whereby, upon movement at a given speed of the press plunger in the working direction of the steering element, the steering element moves at a fraction of the speed of the press plunger, and further comprising locking means communicating with the press plunger, whereby upon contact of the lower die with the workpiece to be pressed, the steering element is locked to the press plunger in such a way that the steering element moves with a speed equal to that of the press plunger.

2. Press according to claim 1, wherein the drive is a lever hinged at one end to the cylinder, and at the other end to the press plunger, the lever supporting the steering element between the pivotal points.

3. Press according to claim 2, wherein the pivotal points of the lever are at an equal distance from the steering element.

4. Press according to claim 2, wherein the lever is in the form of an extensible telescope.

5. Press according to claim 1, wherein the drive comprises two longitudinally successive springs, one being supported against the press plunger with its free end, and the other being supported against the cylinder with its free end, while the adjacent ends of the springs are supported against a collar arranged at the steering element.

6. Press according to claim 5, wherein the springs are of equal lengths and rigidity.

7. Press according to claim 1, wherein the locking means comprises a clamp piston having a cross bore to allow passage of the steering element, and being disposed in a radially extending blind hole of the press plunger, and being longitudinally displaceable against the action of a spring under the pressure exercised by the pressure medium in the cylinder up to the point where a wall of the cross bore bears against the steering element.

8. Press according to claim 7, further comprising a bore in the press plunger arranged parallel to its longitudinal axis, and extending from the lower die to the blind hole for receiving a rod which extends into the blind hole and restricts the movement of the clamp piston.

9. Press according to claim 8, wherein the rod is connected with the lower die.

10. The press of claim 1 further comprising arresting means activated by the steering element for preventing further pressure medium feed to the interior of the cylinder when the steering element reaches a predetermined position.

11. Press according to claim 10, wherein the arresting means comprises a valve plate attached to the end of the steering element which extends from the press plunger, the valve plate cooperating with a valve seat at the cylinder.

12. Press according to claim 11, where the valve plate and the actuating member are arranged on the steering element in a displaceable and adjustable manner.

13. Press according to claim 1, further comprising an actuating member arranged at the steering element for a valve which is located in the pressure medium feed line to the workroom.

14. Press according to claim 1, further comprising an actuating member arranged at the steering element for a switch located in the energy feed of a pressure medium pump.

15. A cylinder used in a press for pressing casings, cable shoes or the like, comprising, a cylindrical body connected to the press, a press plunger disposed within the cylindrical body and having an upper end extending through the press body for supporting a lower die and having a lower end defining a pressure chamber within the cylindrical body, a steering element coaxial with an slideably received in a longitudinal bore in the press plunger, a level pivotally connected at one end to the cylindrical body and at the opposite end to the lower end of the press plunger, the lever having a central passageway through which the steering element extends, a valve plate disposed at an end of the steering element protruding beyond the pressure chamber and into a fluid pressure passageway, and a collar fixedly attached to the steering element, whereby as fluid pressure enters the pressure chamber through the passageway, the press plunger moves in the direction of the fluid pressure, causing upward pivoting of the lever which moves the steering element in the same direction as the press plunger, but at a fractional speed.

16. The cylinder of claim 15 further comprising:

locking means for binding the steering element to the press plunger so that both move at the same speed.

17. The cylinder of claim 16 wherein the locking means comprises a transverse bore intersecting the longitudinal bore of the press plunger, and a clamp disposed within the transverse bore and having a central passageway through which the steering element extends, the clamp piston being axially displaceable when pressure increases in the pressure chamber until a point when the clamp piston binds the steering element to the press plunger.

18. A press for pressing casings, cable shoes or the like, comprising:

a press body supporting an upper die, a cylindrical connected at one end to the press body and having a fluid pressure inlet at the opposite end, a press plunger disposed within the cylinder, the press plunger supporting a lower die at an end extending beyond the cylinder, the lower end of the press plunger and the interior of the cylinder defining a pressure chamber, a steering element having one end slideably received in a longitudinal bore of the press plunger, and an opposite end extending downwardly from the press plunger and into the path of the fluid pressure inlet, a collar disposed on the steering element, a level having a central passageway through which extends the steering element and being pivotally connected at one end to a shoulder in the pressure chamber, and at the opposite end to a lower portion of the press plunger, a valve seat disposed between the fluid pressure inlet and the pressure chamber, whereby as fluid pressure enters the cylinder, the press plunger moves upwardly in the direction of the fluid pressure, and the lever moves the steering element in the same direction but at a fractional speed.

19. The press of claim 18 further comprising:

a transverse bore in the press plunger innerconnected with the longitudinal bore, and a clamp piston disposed within the transverse bore and having a central passageway through which the steering element extends, whereby upon increased fluid pressure generated by the lower die contacting a work piece, the clamp piston is forced outwardly and binds the steering element to the press plunger so that the press plunger and the steering element move in unison until the valve plate at the lower end of the steering element contacts the valve seat thereby cutting off the fluid pressure source and preventing further advancement of the press plunger.

20. The press of claim 18 further comprising:

a replaceable lower die mounted on the upper end of the press plunger and having a longitudinally extending rod insertable into a longitudinal bore provided near the periphery of the press plunger, the longitudinal bore extending downwardly into the transverse bore of the press plunger such that the rod extends into the transverse bore to prevent the clamp piston from moving outwardly in response to increased pressure.

* * * * *